US006164188A

United States Patent [19]

Miser

[11] Patent Number: 6,164,188

[45] Date of Patent: Dec. 26, 2000

[54] RECIPROCATING PUMP/COMPRESSOR WITH SELF-ALIGNING PISTON

[76] Inventor: H T Miser, 3510 Crosscreek Ct., Missouri City, Tex. 77459

[21] Appl. No.: 09/197,949

[22] Filed: Nov. 23, 1998

[51] Int. Cl.[7] ..... F16J 1/10; B25G 3/00

[52] U.S. Cl. ..... 92/84; 92/129; 92/172; 403/14

[58] Field of Search ..... 92/84, 129, 140, 92/172, 187, 208, 209, 233, 165 R; 403/13, 14

[56] References Cited

U.S. PATENT DOCUMENTS

| | | | |
|---|---|---|---|
| 3,173,266 | 3/1965 | Shutt | 92/169.1 |
| 3,276,390 | 10/1966 | Bloudoff et al. | 92/61 |
| 3,298,317 | 1/1967 | Griffin | 92/60 |
| 3,406,992 | 10/1968 | Grotness | 92/145 |
| 3,544,138 | 12/1970 | Von Eiff | 403/338 X |
| 3,589,756 | 6/1971 | Pruvot | 92/187 X |
| 3,670,630 | 6/1972 | Tyson et al. | 92/129 |
| 3,744,577 | 7/1973 | Williams | 403/338 X |
| 4,033,701 | 7/1977 | Labyer et al. | 403/13 |
| 4,120,596 | 10/1978 | Kunkle | 403/14 |
| 4,160,626 | 7/1979 | Bell | 92/84 X |
| 4,252,458 | 2/1981 | Keen | 403/287 |
| 4,349,955 | 9/1982 | Keen | 29/526 R |
| 4,380,951 | 4/1983 | Bottoms | 92/244 |
| 4,428,275 | 1/1984 | Huperz et al. | 92/188 |
| 4,511,276 | 4/1985 | Doutt | 403/77 |
| 4,556,371 | 12/1985 | Post | 417/539 |
| 4,719,844 | 1/1988 | Dugan | 403/13 X |
| 4,719,845 | 1/1988 | Dugan | 92/84 |
| 4,872,395 | 10/1989 | Bennitt et al. | 92/139 |
| 4,977,817 | 12/1990 | Doman | 92/31 |
| 5,031,512 | 7/1991 | Graziani | 92/139 |
| 5,082,391 | 1/1992 | Florida | 403/342 |
| 5,085,129 | 2/1992 | Dugan | 92/84 |
| 5,127,807 | 7/1992 | Eslinger | 403/371 X |
| 5,247,873 | 9/1993 | Owens et al. | 92/157 |
| 5,507,219 | 4/1996 | Stogner | 92/128 |
| 5,778,759 | 7/1998 | Johnson | 92/129 |
| 5,823,093 | 10/1998 | Kugelev et al. | 92/128 |

*Primary Examiner*—John E. Ryznic
*Attorney, Agent, or Firm*—Akin, Gump, Strauss, Hauer & Feld, L.L.P.

[57] ABSTRACT

A reciprocating pump or compressor has an alignment adapter for providing a self-aligning piston rod. The alignment adapter and a clamp couple the piston rod to a crosshead extension rod. The alignment adapter provides compensation for misalignment of the longitudinal axis of the crosshead extension rod with the longitudinal axis of the piston rod. The alignment adapter has a hemispherical cavity, and the piston rod has a hemispherical projection that matingly fits within the hemispherical cavity. A split ring is received in a groove in the piston rod, and the piston rod and the split ring are received in the cavity in the alignment adapter for use in coupling the piston rod to the alignment adapter. A piston head has a hemispherical cavity for receiving a hemispherical projection on a piston rod. The piston head has a longitudinal midpoint, and the hemispherical projection has a focal point for a radius of curvature. The focal point is located forward of the midpoint so that the piston rod tends to pull the piston head, which allows the piston head to align within a piston cylinder.

33 Claims, 5 Drawing Sheets

RECIPROCATING PUMP/COMPRESSOR WITH SELF-ALIGNING PISTON

BACKGROUND OF THE INVENTION

1. Field of the Invention

This invention pertains to reciprocating pumps and compressors, and more particularly to a reciprocating pump or compressor having a self-aligning piston rod and/or piston head.

2. Description of the Related Art

In reciprocating pumps and compressors, such as in a mud pump used in the oil well drilling industry, precise alignment of longitudinal axes of coupled rods and of rods coupled to piston heads minimizes wear in the reciprocating pump or compressor. Misalignment, on the other hand, leads to premature and excessive wear and scarring of piston cylinder liners. In general, misalignment of the longitudinal axes of coupled rods and piston heads limits the run life of the pump or compressor in which the rods and heads are disposed. The problems associated with misalignment of rods in a mud pump are disclosed in U.S. Pat. No. 5,778,759, issued to Johnson.

U.S. Pat. No. 4,719,845, issued to Dugan, discloses a joint for connecting two rods together for reciprocation along aligned longitudinal axes. The joint is designed to compensate for misalignment while transmitting a reciprocating force. The joint is used in a mud pump for pumping drilling fluid or mud downhole for carrying cuttings away from a drill bit. A piston head is connected to a piston rod, which in turn is connected to a crosshead rod. The crosshead rod is connected to a crank, which is driven by a motor to provide reciprocating motion on the crosshead rod, the piston rod and the piston head.

The Dugan '845 patent discloses a joint for connecting the crosshead rod to the piston rod, which comprises a cylindrical cavity formed in one end of the piston rod and a cylindrical plug formed on the associated end of the crosshead rod. The plug is inserted into the cavity, and the plug has a slightly smaller diameter than that of the cavity to allow for slight axial and/or lateral misalignment. A solid, deformable, non-compressible material is located in the cavity. Misalignrment between the crosshead rod and the piston rod is accommodated by deformation of the non-compressible material. A uniform force is thus said to be transmitted across the surface area of the cavity in the piston rod. However, the non-compressible material tends to wear out, and a number of parts must be assembled, making installation difficult.

SUMMARY OF THE INVENTION

A reciprocating pump or compressor has a self-aligning joint between a crosshead extension rod and a piston rod and/or between the piston rod and a piston head. The self-aligning joint has a long operating life and is easy to install and relatively inexpensive. The self-aligning joint includes a concave shape, preferably having the shape of a hemisphere, and a corresponding convex shape for matingly engaging the concave shape.

In one embodiment, a crosshead extension rod terminates with an end having a conventional shape. An alignment adapter matingly engages the end of the crosshead extension rod, and a clamp couples the alignment adapter to the crosshead extension rod. The alignment adapter has a cavity forming a concave-receiving surface for receiving an end of the piston rod. The end of the piston rod has a corresponding convex surface for matingly engaging the concave-receiving surface within the alignment adapter.

As a first alternative, this arrangement can be reversed to provide the alignment adapter with a convex surface and the end of the piston rod with a concave surface, in which case the piston rod terminates with an end having a cavity forming a concave surface for receiving the convex surface of the alignment adapter. As a second alternative, both the alignment adapter and the associated end of the piston rod can each have a cavity with a concave surface, and a mass can be placed between the concave surface in the alignment adapter and the concave surface in the associated end of the piston rod. Preferably, the mass has the shape of a sphere, and the cavities in the alignment adapter and in the associated end of the piston rod each have the shape of a hemisphere.

A fastening system couples the piston rod to the alignment adapter, forming a joint that can compensate for misalignment between the longitudinal axis of the crosshead extension rod and the longitudinal axis of the piston rod. The coupling of the piston rod to the alignment adapter is preferably non-rigid.

A conventional piston head can be attached to an opposing end of the piston rod, or the opposing end of the piston rod can terminate as a plunger in a plunger-type pump. Alternatively, the piston head can have a concave shape for receiving an end of the piston rod, which has a corresponding convex shape for matingly engaging the concave shape in the piston head. Preferably, the piston head has a hemispherical cavity, and the associated end of the piston rod terminates in a hemispherical shape, which corresponds in its dimensions to the hemispherical cavity in the piston head. A coupling system engages the piston rod with the piston head, preferably flexibly, providing a self-aligning joint. The piston head can thus align itself within a piston cylinder.

In one embodiment the piston head has a hemispherical concave shape, and the associated end of the piston rod has a mating hemispherical convex shape. The piston rod has a focal point for a radius of curvature of its hemispherical convex shape. The piston head has a back end, which receives the piston rod, and an opposing front end. The piston head has a longitudinal midpoint between the back end and the front end. In a preferred embodiment, the focal point of the radius of curvature of the hemispherical convex shape on the piston rod is located between the midpoint and the front end of the piston head. This allows the piston rod to essentially "pull" the piston seal rather than push it, which improves the alignment of the piston head in the piston cylinder.

The piston head can thus be coupled to a piston rod using the self-aligning joint, and either a conventional joint can be used for coupling the piston rod to a crosshead extension rod or a self-aligning joint can be used for coupling the piston rod to the crosshead extension rod.

In another embodiment, a piston-rod adapter or standardization adapter is coupled to a conventional crosshead extension rod. A clamp can be used to couple the standardization adapter to the crosshead extension rod. The standardization adapter has a receiving cavity, such as a cylindrical cavity, and an associated end of a piston rod terminates with a corresponding convex shape, such as a cylindrical shape. The associated end of the piston rod is received in the receiving cavity of the standardization adapter, and the piston rod is coupled to the standardization adapter, such as by threaded engagement.

The standardization adapter can be customized to fit a variety of sizes and shapes of crosshead extension rods, while having a single, standard receiving cavity for receiving a piston rod. Thus, a single, standard-sized piston rod can be used and can be coupled to a variety of crosshead extension rods using the standardization adapter. An opposing end of the piston rod can be coupled to a piston head, either conventionally or with a self-aligning joint.

DETAILED DESCRIPTION OF THE INVENTION

Figure 1:
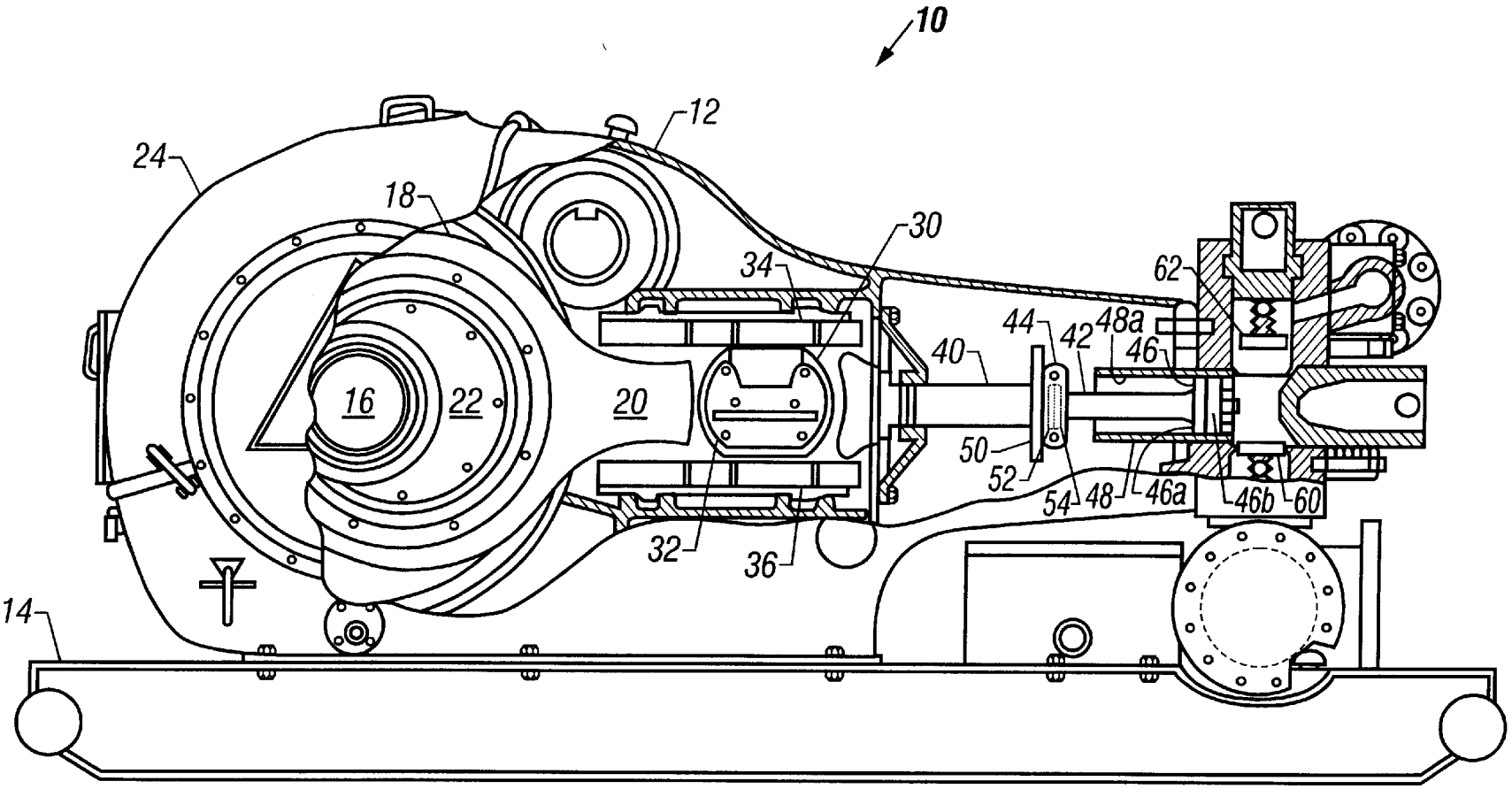
FIG. 1 is a side view in partial cross section of a reciprocating pump.

With reference to FIG. 1, a reciprocating pump generally designated as 10 includes a housing 12 mounted on a frame 14. A driver (not shown), such as a diesel engine, is operatively connected to a crankshaft 16 for providing a rotative driving force. A crank 18 is connected to crankshaft 16, and a connecting rod 20 reciprocates in a known manner as crankshaft 16 rotates.

In general, a gear end 22 converts rotating motion into reciprocating motion. A cover 24 can be opened for providing access to gear end 22. A crosshead 30 is connected to connecting rod 20 by a crosshead pin 32. An upper crosshead shoe 34 and a lower crosshead shoe 36 slide in reciprocating motion. A crosshead extension rod 40 is connected to crosshead 30, and a piston rod 42 is connected to crosshead extension rod 40 by a clamp 44.

A piston head 46, connected to piston rod 42, reciprocates within a piston cylinder 48. Piston cylinder 48 typically has a liner, which is not shown. A baffle 50 surrounds crosshead extension rod 40. Crosshead extension rod 40 has a flanged end 52, and piston rod 42 has a flanged end 54. Flanged ends 52 and 54 are shown in hidden lines within clamp 44. Clamp 44 clamps around flanged ends 52 and 54, holding piston rod 42 in axial alignment with crosshead extension rod 40.

A suction valve assembly 60 opens and closes in coordination with the reciprocation of piston head 46 so that fluid is drawn into piston cylinder 48 as piston head 46 retracts. Pump 10 is shown in FIG. 1 as completing a pumping stroke, in which suction valve assembly 60 is closed, and a discharge valve assembly 62 is open. Discharge valve assembly 62 closes, and piston head 46 begins to retract, while suction valve assembly 60 begins to open.

Thus, reciprocation of piston head 46 within piston cylinder 48 provides a pumping action for discharging fluid through discharge valve assembly 62. Typically, a charge pump (not shown) is used for pumping fluid into piston cylinder 48 while suction valve assembly 60 is open. Consequently, it is not necessary for a strong suction to be developed within piston cylinder 48 by piston head 46 to charge the cylinder.

Pump 10 can be used for pumping drilling fluid into an oil or gas well during drilling operations. When wells are drilled into the earth, a drilling fluid known as drilling mud is used to carry away cuttings from the drill bit. Several piston cylinders and piston heads comparable to piston cylinder 48 and piston head 46 operate cooperatively within pump 10 to pump drilling fluid down into the oil well, where cuttings are picked up and circulated back to the surface. The cuttings are cleaned out of the drilling fluid, and the drilling fluid is recirculated down into the hole by pump 10.

Pump 10 is typically a massive piece of equipment that operates continuously. Components wear out, and pump 10 must be taken out of service for repairs and maintenance. Repairs and maintenance are costly due to lost production time, as well as from the cost of labor and parts. Piston head 46 includes a metal hub 46*a* and a rubber seal 46*b*. There is typically a gap between metal hub 46*a* and an inside wall 48*a* of piston cylinder 48 of about 0.005 inches. Misalignment among these various components causes wear on inside wall 48*a* as metal hub 46*a* rubs and scars inside wall 48*a*. Further, such misalignment causes premature wear on crankshaft 16, crank 18, connecting rod 20, gear end 22, crosshead 30 and crosshead pin 32. The self-aligning joint according to the present invention provides compensation for misalignment, which reduces such wear.

Figure 2:
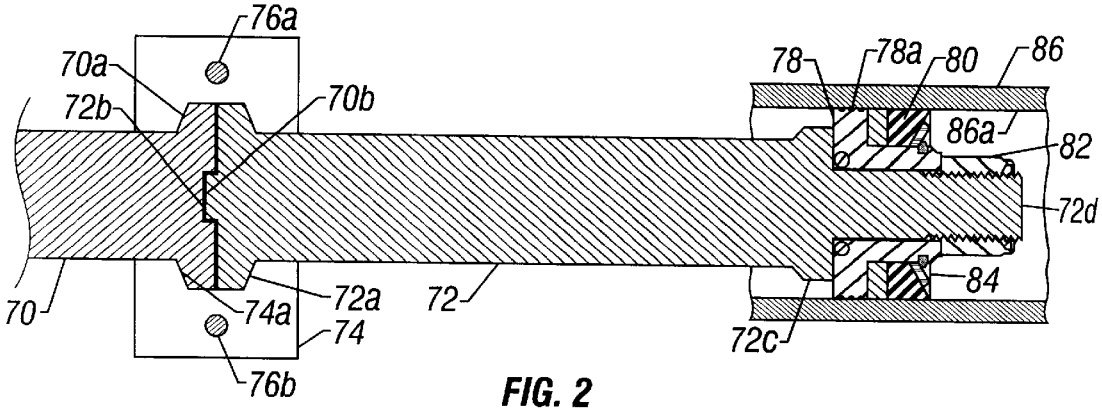
FIG. 2 (PRIOR ART)
FIG. 2 is a cross section of a prior art piston rod.

With reference to FIG. 2, a prior art arrangement for a piston rod and piston head is illustrated in cross section. A crosshead extension rod 70 is connected to a piston rod 72 by a clamp 74. Crosshead extension rod 70 has a flanged end 70*a*, which has a cylindrical recess 70*b*. Piston rod 72 has a flanged end 72*a*, which has a cylindrical projection 72*b* that matingly engages cylindrical recess 70*b* on crosshead extension rod 70. Clamp 74 has a recess 74*a* that receives flanged ends 70*a* and 72*a* for rigidly connecting piston rod 72 to crosshead extension rod 70. Clamp bolts 76*a* and 76*b* fasten two halves of clamp 74 together.

Crosshead extension rod 70 in FIG. 2 is comparable to crosshead extension rod 40 in FIG. 1. If the prior art arrangement for the piston rod and piston head illustrated in FIG. 2 is incorporated in FIG. 1, then FIG. 1 represents prior art. However, if the components illustrated in FIGS. 3–12 are incorporated in FIG. 1, then FIG. 1 is according to the present invention.

Piston rod 72 has a flange 72*c* and a threaded shank 72*d*. A metal piston hub 78 is received on threaded shank 72*d*. A rubber seal 80 is received on metal hub 78, and threaded nut 82 holds an assembly of components including metal hub 78 and rubber seal 80 together to form a piston head 84.

Piston head 84 is received in a piston cylinder 86, which has an inside wall 86*a*. Metal hub 78 has an outside wall 78*a*, and the spacing between outside wall 78*a* of metal hub 78 and inside wall of 86*a* of piston cylinder 86 is typically about 0.005 inches. Piston head 84, piston rod 72, and crosshead extension rod 70 are all rigidly connected together. Consequently, any misalignment of these various components can cause outside wall 78*a* of metal hub 78 to rub and wear inside wall 86*a* of piston cylinder 86. This leads to premature failure of the seal on piston head 84 within piston cylinder 86.

Figure 3:
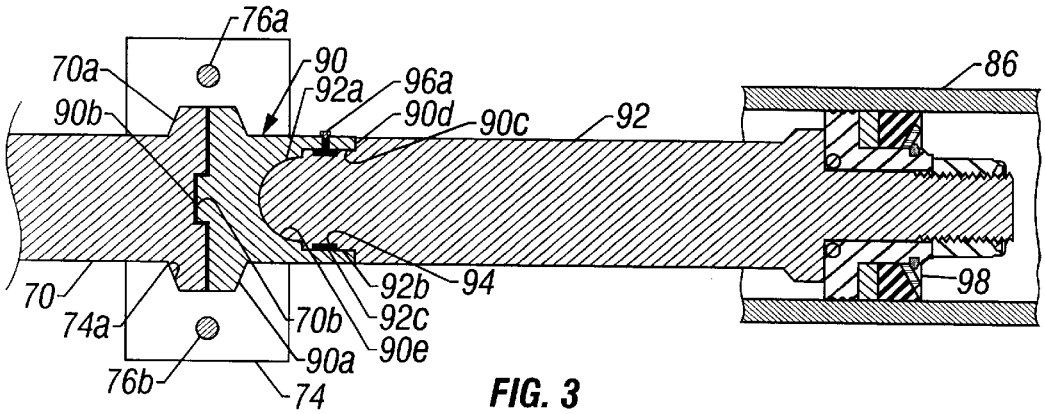
FIG. 3 is a cross section of a piston rod and an alignment adapter according to the present invention.
Figure 4:
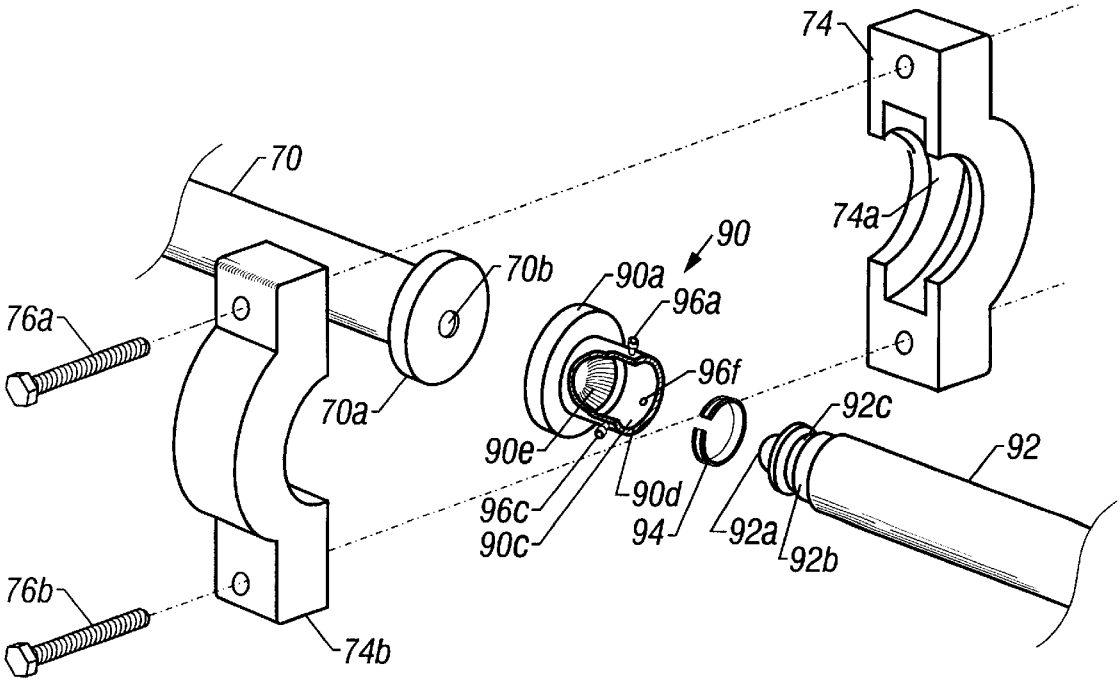
FIG. 4 is an exploded, perspective view of the piston rod and alignment adapter of FIG. 3.

Turning now to FIGS. 3 and 4, an alignment adapter 90 of this invention is shown clamped to crosshead extension rod 70. Alignment adapter 90 has a flanged end 90*a*, and flanged end 90*a* has a cylindrical projection 90*b* that engages cylindrical cavity 70*b*. Clamp 74 holds alignment adapter 90 in engagement with crosshead extension rod 70.

Alignment adapter 90 has a concave shape including a cylindrical cavity 90*c* adjacent to an outer edge 90*d*. At a greater depth, the concave shape in alignment adapter 90 includes a hemispherical cavity 90*e*. Thus, hemispherical cavity 90*e* has a shape for receiving one half of a sphere or ball.

A piston rod 92 terminates in a convex shape, which is illustrated as hemisphere 92*a*. Thus, piston rod 92 has a hemispherical projection 92*a*, which is received in hemispherical cavity 90*e* in alignment adapter 90. Hemispherical projection 92*a* matingly engages hemispherical cavity 90*e*. Alternative shapes can be used for the concave shape in alignment adapter 90, such as a hemicylindrical shape, which is the shape of one-half of a cylinder as cut along its longitudinal axis. The convex shape of the of piston rod 92 corresponds to the concave shape in alignment adapter 90 for mating engagement. An elliptical shape, for example, may be satisfactory in some applications.

Piston rod 92 has a cylindrical projection 92*b* that is received within cylindrical cavity 90*c* in alignment adapter 90. Cylindrical projection 92*b* has a groove 92*c*. A split ring 94 is received in groove 92*c*. Bolts 96*a*, 96*b* and 96*c* pass through threaded holes in alignment adapter 90 and press split ring 94 into groove 92*c*. (Bolt 96*b* is not shown.) A threaded hole 96*f* in alignment adapter 90 is threaded for receiving bolt 96*b*. Bolts 96*a*, 96*b* and 96*c* are preferably of a length such that an associated bolt head can contact an outer surface of alignment adapter 90, while pressing split ring 94 into groove 92*c* a proper amount. Bolts 96*a*, 96*b* and 96*c* are further preferably of a type that has a mechanism for inhibiting the tendency of the bolts to back out of its associated threaded hole.

Alignment adapter 90 provides a flexible connection between piston rod 92 and crosshead extension rod 70. This flexible connection provides compensation for misalignment. A metal-to-metal bearing surface is provided where hemispherical projection 92*a* contacts hemispherical cavity 90*e*, and this bearing surface allows for misalignment between a longitudinal axis of extension rod 70 and an longitudinal axis of piston rod 92. The bearing surface provides a strong, long-lasting joint.

On the pumping stroke, force is provided to piston rod 92 from crosshead extension rod 70 by hemispherical projection 92*a* bearing within hemispherical cavity 90*e*. On the retract stroke, bolts 96*a*, 96*b* and 96*c* press split ring 94 into groove 92*c*, which couples piston rod 92 to alignment adapter 90. Alignment adapter 90 is fastened to crosshead extension rod 70 by clamp 74, which has a mating half 74*b* (FIG. 4). In this embodiment, piston rod 92 has a conventional piston head 98 received in piston cylinder 86.

Figure 5:
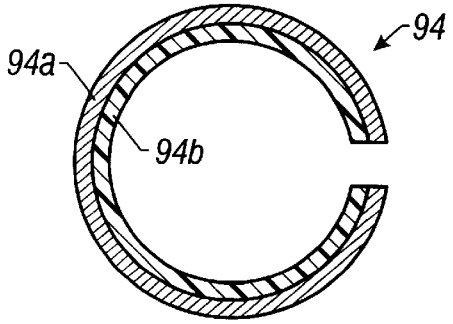
FIG. 5 is a side view of a split ring in cross section, according to the present invention.

With reference to FIG. 5, split ring 94 is shown in cross section and has an outer metal layer 94*a* and an inner resilient layer 94*b*. Bolts 96*a*, 96*b* and 96*c* (FIG. 4) engage outer metal layer 94*a* and press inner resilient layer 94*b* into frictional engagement with piston rod 92 within groove 92*c* (FIG. 4). Examples of materials suitable for making resilient layer 94*b* include polyurethane, acrylonitrile and/or rubber. Resilient layer 94*b* is bonded to metal layer 94*a*.

Figure 6:
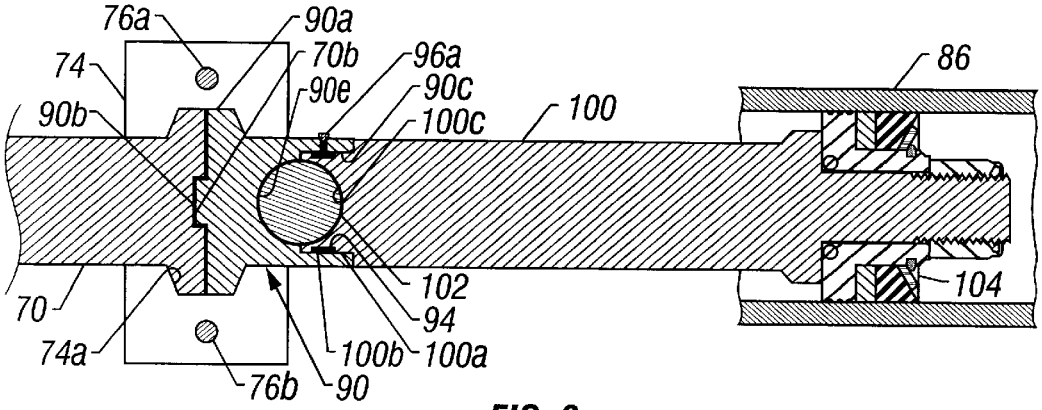
FIG. 6 is a cross section of a piston rod and alignment adapter using a sphere where the piston rod is coupled to the alignment adapter, according to the present invention.
Figure 7:
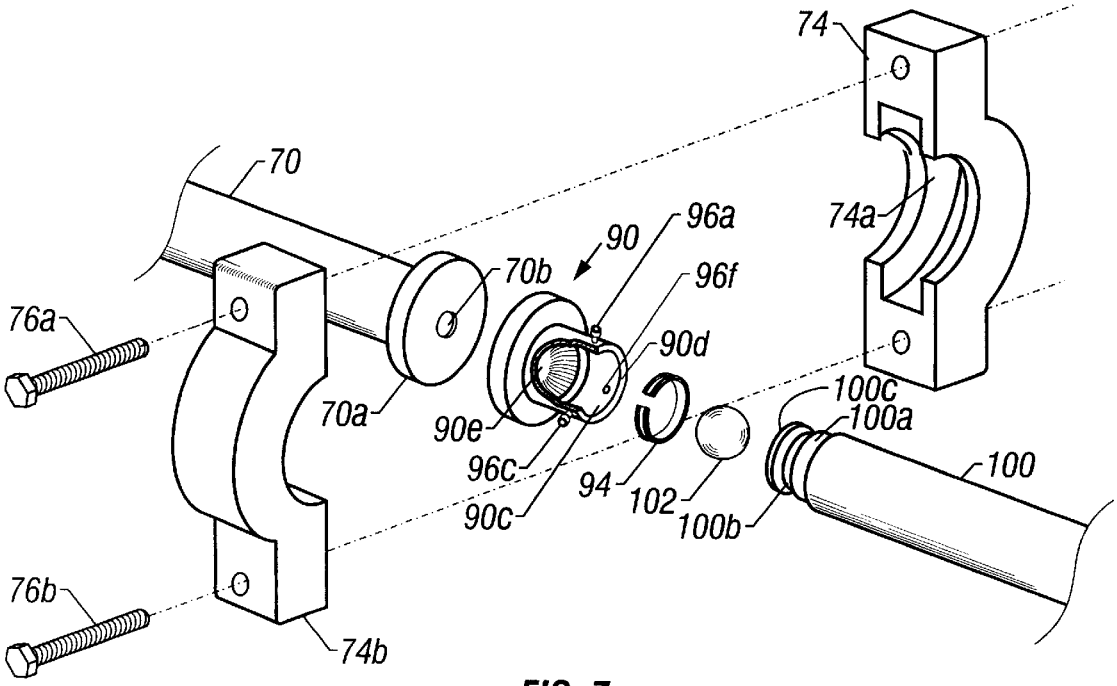
FIG. 7 is an exploded perspective view of the piston rod, sphere and alignment adapter of FIG. 6.

Turning now to FIGS. 6 and 7, an alternative embodiment is illustrated for the engagement between a piston rod 100 and alignment adapter 90. In this embodiment piston rod 100 terminates in a cylindrical projection 100*a*, which has a circumferential groove 100*b* into which split ring 94 is received. Cylindrical projection 100*a* has a hemispherical cavity 100*c*, which is a mirror image of hemispherical cavity 90*e* in alignment adapter 90. A ball 102 is matingly received in hemispherical cavities 90*e* and 100*c*. Thus, ball 102, hemispherical cavity 90*e* in alignment adapter 90 and hemispherical cavity 100*c* in piston rod 100 provide a flexible joint that compensates for misalignment between the longitudinal axis of crosshead extension rod 70 and the longitudinal axis of piston rod 100.

The engagement of alignment adapter 90 with crosshead extension rod 70 is the same as described above. Also, as described above, bolts 96*a*, 96*b* (not shown) and 96*c* engage split ring 94, providing engagement between piston rod 100 and alignment adapter 90. Piston rod 100 has a piston head 104 received in piston cylinder 86. In this embodiment, piston head 104 is comparable to piston head 84 in FIG. 2.

Figure 8:
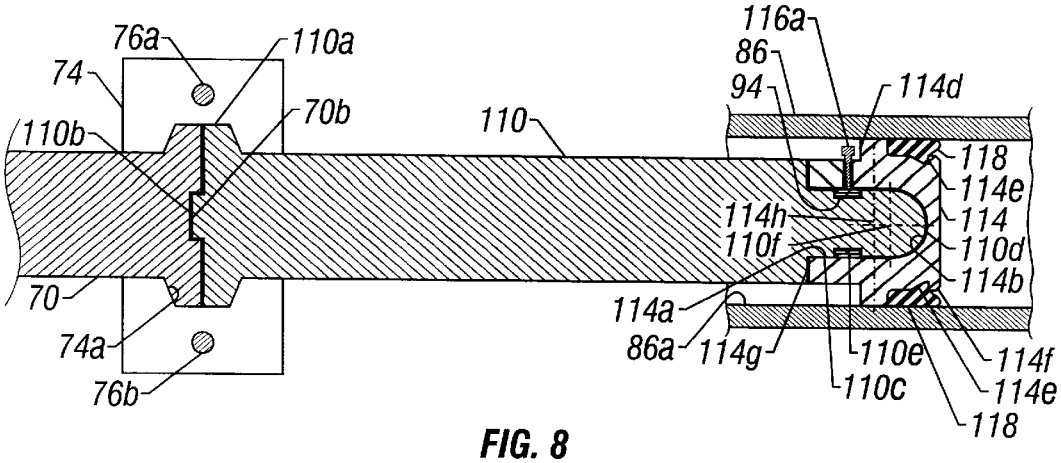
FIG. 8 is a cross section of a piston rod and piston head, according to the present invention.
Figure 9:
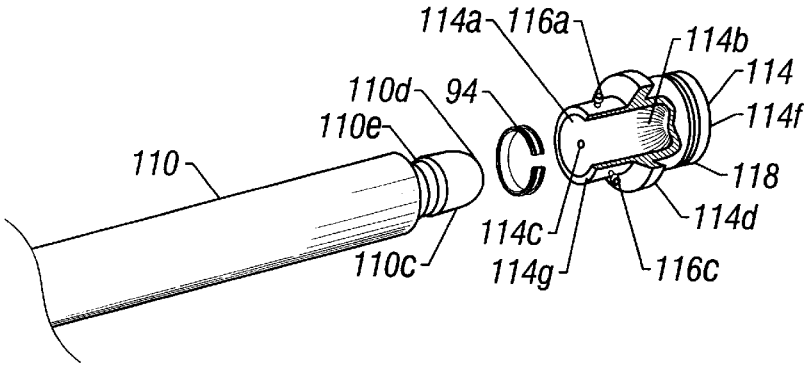
FIG. 9 is an exploded perspective view of the piston rod and piston head of FIG. 8.

Turning now to FIGS. 8 and 9, a piston rod 110 is shown secured to crosshead extension rod 70 by clamp 74. Piston rod 110 has a flanged end 110*a* and a cylindrical projection 110*b* that is matingly received in cylindrical cavity 70*b* in crosshead extension rod 70. Piston rod 110 has a cylindrical projection 110*c*, which terminates in a hemispherical projection 110*d*. Cylindrical projection 110*c* has a circumferential groove 110*e*, in which is received split ring 94 of FIG. 5.

A piston head 114 has a cylindrical cavity 114*a* that matingly receives cylindrical projection 110*c* on piston rod 110. Cylindrical cavity 114*a* terminates inwardly with a hemispherical cavity 114*b*. Hemispherical cavity 114*b* in piston head 114 matingly receives hemispherical projection 110*d* on piston rod 110.

Bolts 116*a*, 116*b* (not shown) and 116*c* are threadedly received in holes in piston head 114. A threaded hole 114*c* is provided for receiving bolt 116*b*. Bolts 116*a*, 116*b* and 116*c* press split ring 94 into groove 110*e* in piston rod 110 for securing piston head 114 to piston rod 110.

Piston head 114 has a shoulder 114*d*, which can be formed integral with piston head 114, which is typically made of a metal material. Piston head 114 has an indented shape 114*e*, which can have a variety of configurations. A seal 118 is received circumferentially about piston head 114 within indented shape 114*e*, which provides a shape for engagement between seal 118 and piston head 114. Shoulder 114*d* provides support for seal 118 as piston rod 110 operates through a pumping stroke.

With reference to FIG. 8, hemispherical projection 110*d* on piston rod 110 has a center of radius with a focal point 110*f*. Piston head 114 has a distal end 114*f* and a proximal end 114*g*. Piston head 114 has a midpoint 114*h*, which is centrally located between distal end 114*f* and proximal end 114*g*.

Center of radius focal point 110*f* of hemispherical end 110*d* of piston rod 110 is located slightly toward distal end 114*f* with respect to midpoint 114*h*. Thus, center of radius 110*f* is located between midpoint 114*h* and distal end 114*f* of piston head 114. By locating center of radius 110*f* between midpoint 114*h* and distal end 114*f*, piston rod 110 tends to pull piston head 114 rather than push it. Misalignment of piston head 114 within piston cylinder 86 is compensated for by the engagement of hemispherical projection 110*d* on piston rod 110 with hemispherical cavity 114*b* in piston head 114 and by locating the center of radius 110*f* distal of midpoint 114*h* with respect to crosshead extension rod 70.

Figure 10:
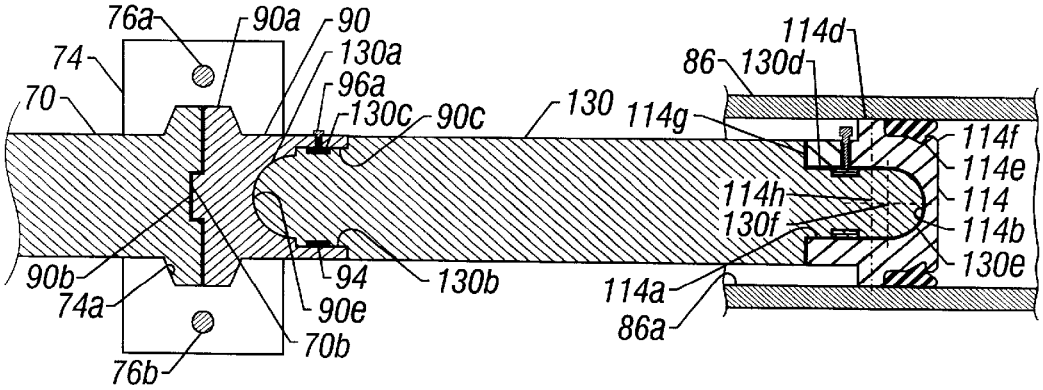
FIG. 10 is a cross section of a piston rod, alignment adapter and piston head, according to the present invention.

Turning now to FIG. 10, a piston rod 130 is coupled to the piston head 114 described with reference to FIGS. 8 and 9. Piston rod 130 is connected to alignment adapter 90, as was described with reference to FIGS. 3 and 4. Piston rod 130 terminates in a hemispherical projection 130*a* that is matingly received in hemispherical cavity 90*e* in alignment adapter 90. Piston rod 130 has a cylindrical projection 130*b*, and cylindrical projection 130*b* has a groove 130*c* that receives split ring 94 of FIG. 5. Thus, piston rod 130 is coupled to crosshead extension rod 70 using alignment adapter 90 and clamp 74, as was described with reference to FIGS. 3 and 4. Piston rod 130 can rotate within alignment adapter 90 where hemispherical projection 130*a* engages hemispherical cavity 90*e*, providing a flexible connection that can compensate for misalignment of the longitudinal axis of piston rod 130 with the longitudinal axis of crosshead extension rod 70.

The connection of piston rod 130 (FIG. 10) with piston head 114 provides a second flexible connection that compensates for misalignment of piston rod 130 and piston head 114 within piston cylinder 86. Piston rod 130 has a cylindrical projection 130*d* that terminates in a hemispherical projection 130*e*. Hemispherical projection 130*e* is received in hemispherical cavity 114*b*, as described above with reference to FIGS. 8 and 9. Hemispherical projection 130*e* has a center of radius with a focal point 130*f*.

As was described with reference to FIGS. 8 and 9, center of radius focal point 130*f* (FIG. 10) is located between distal end 114*f* and midpoint 114*h* of piston head 114. Distal end 114*f* of piston head 114 is located distal of crosshead extension rod 70 and on a forward end of piston head 114 with respect to the pumping stroke of piston rod 130. By having center of radius focal point 130*f* of hemispherical projection 130*e* of piston rod 130 closer to the forward end 114*f* of piston head 114 with respect to the pumping stroke, piston rod 130 tends to pull piston head 114 rather than push it. This tends to align piston head 114 within inside wall 86*a* of piston cylinder 86.

Figure 11:
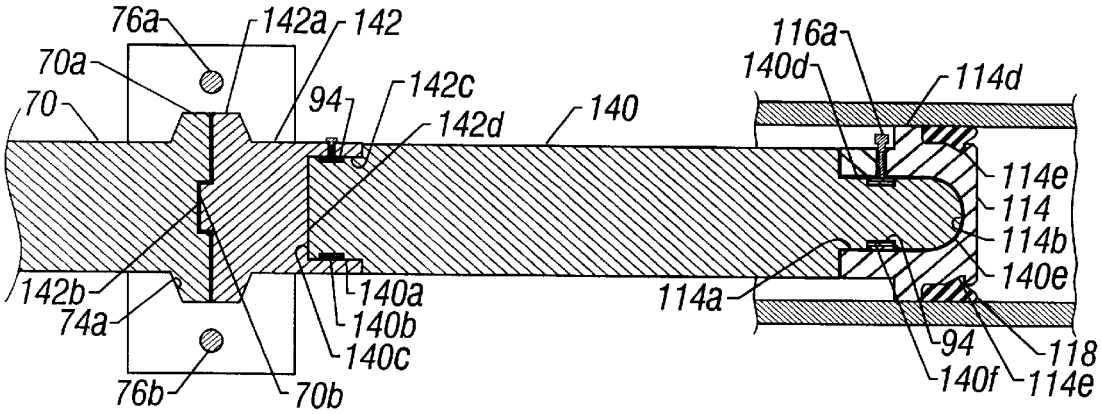
FIG. 11 is a cross section of a piston rod, piston head and a standardization adapter, according to the present invention.
Figure 12:
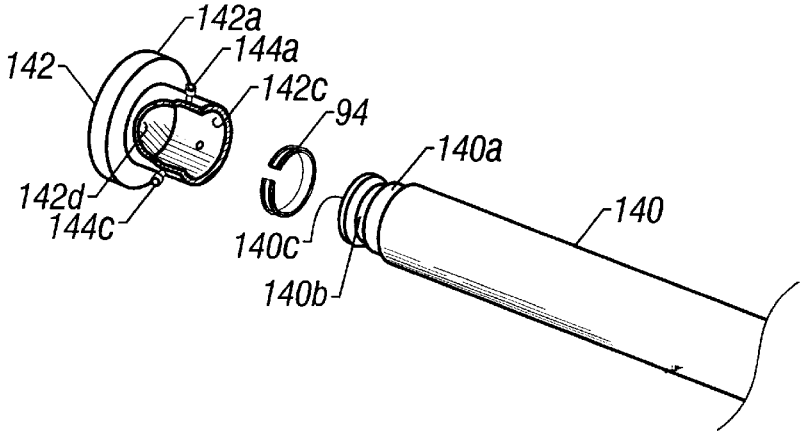
FIG. 12 is an exploded perspective view of the piston rod and standardization adapter of FIG. 11.

Turning now to FIGS. 11 and 12, a piston rod 140 is coupled to piston head 114 as described with reference to FIGS. 8–10. In this embodiment, a standardization adapter 142 is provided for coupling piston rod 140 to crosshead extension rod 70. Crosshead extension rod 70, its flanged end 70*a*, and its cylindrical recess 70*b* all vary in size with different pump manufacturers. Standardization adapter 142 is provided so that a single-size piston rod 140 can be coupled to a variety of shapes and sizes for crosshead extension rod 70. Thus, inventory of piston rods can be minimized, as several different standardization adapters 142 can be machined to fit the variety of crosshead extension rods found at a drill site, while one size of piston rod 140 can be maintained in inventory.

Standardization adapter 142 has a flanged end 142*a*, which has a projection 142*b* that is matingly received in recess 70*b* of crosshead extension rod 70. Standardization adapter 142, in this embodiment, has a cylindrical cavity 142*c*. Cavity 142*c* can have a variety of shapes, and a cylindrical shape is used for purposes of illustration. Piston rod 140 has a cylindrical projection 140*a* that is matingly received in cylindrical cavity 142*c* in standardization adapter 142. Cylindrical extension 140*a* of piston rod 140 has a circumferential groove 140*b* for receiving split ring 94 of FIG. 5. Bolts 144*a*, 144*b* (not shown) and 144*c* are threadedly engaged in holes in standardization adapter 142.

Piston rod 140 has a flat end 140*c*, and standardization adapter 142 has a flat interior surface 142*d*. Surface 140*c* of piston rod 140 bears against surface 142*d* of standardization adapter 142 during the pumping stroke. During the retract stroke, the engagement of bolts 144*a*, 144*b* and 144*c* with split ring 94, which is pressed into groove 140*b* of piston rod 140 provides a coupling between piston rod 140 and standardization adapter 142. Alternatively, standardization adapter 142 can have female threads in cylindrical cavity 142*c*, and cylindrical projection 140*a* of piston rod 140 can have male threads for threaded engagement of piston rod 140 with standardization adapter 142.

Continuing to reference FIGS. 11 and 12, piston rod 140 is connected to piston head 114 in the same manner that piston head 114 is connected to piston rod 110 of FIGS. 8 and 9. Piston rod 140 has a cylindrical projection 140*d*, which terminates in a hemispherical projection 140*e*. Cylindrical projection 140*d* has a circumferential groove 140*f*, in which is received split ring 94 (FIG. 5). Bolts 116*a*, 116*b* (not shown) and 116*c* (not shown) press split ring 94 into groove 140*f* for coupling piston head 114 to piston rod 140. The focal point of the center of radius of hemispherical projection 140*e* is not shown in FIG. 11, but is the same as described with reference to FIGS. 8–10.

In summary, alignment adapter 90 can be used to couple piston rods 92, 100, and 130 to crosshead extension rod 70 using clamp 74. Allowing rotation or movement in 360 degrees, alignment adapter 90 provides compensation for misalignment of the longitudinal axis of crosshead extension rod 70 with the longitudinal axis of the piston rods 92, 100 and 130. This reduces wear inside piston cylinder 86. This compensation for misalignment also reduces wear on and extends the life of the power end and gear end 22 of pump 10, as well as of crosshead pin 32 and of bearings in the crosshead. Ball 102 in FIGS. 6 and 7 provides an alternative embodiment for the hemispherical projection 92*a* for piston rod 92 (FIG. 3) and hemispherical projection 130*a* of piston rod 130 (FIG. 10).

In another aspect, hemispherical cavity 114*b* of piston head 114 receives hemispherical projection 110*d* of piston rod 110 (FIG. 8), allowing rotation or movement in 360 degrees, which compensates for misalignment of piston head 114 within piston cylinder 86. By locating radius of curvature focal point 110*f* (FIG. 8) between longitudinal midpoint 114*h* of piston head 114 and distal end 114*f* of piston head 114, piston rod 110 tends to pull piston head 114 rather than push it. This helps to properly align piston head 114 within piston cylinder 86, which minimizes wear inside piston cylinder 86 and extends the life of the power end of pump 10.

In the past, a considerable inventory of piston rods 72 (FIG. 2) was kept at a drill site, one type of piston rod 72 for each type of crosshead extension rod 70. A drill site may have two or three different mud pumps 10, which required a great deal of inventory of a variety of piston rods 72, recognizing that piston rod 72 has minor differences between different pump manufactures. Standardization adapter 142 (FIG. 11) provides for a small part to be kept in inventory, one standardization adapter 142 for each different type of crosshead extension rod 70. By using standardization adapter 142, a single, standard-sized piston rod 140 can be kept in inventory, which minimizes inventory overall.

Another advantage or benefit of components made according to the present invention is ease of installation. For example, if a seal needs to be replaced on a piston head according to the present invention, merely three bolts need to be removed to disengage a piston rod from the piston head. The piston head can then be removed from the piston cylinder; the seal can be replaced; and the steps can be reversed to reinstall the piston head.

Although pump 10 has been illustrated in conjunction with the detailed description of the present invention, a reciprocating compressor according to the present invention is contemplated, as are other embodiments of reciprocating pumps. The alignment adapter, the self-aligning joint, the piston rod, the piston head and/or the standardization adapter, can be used in applications beyond those described herein, such as in applications involving a reciprocating motion. For example, the present invention can be adapted for use in hydraulic cylinders and in various types of pistons.

The foregoing disclosure and description of the invention are illustrative and explanatory thereof, and various changes in the details of the illustrated apparatus and construction and method of operation may be made without departing from the spirit of the invention.

What is claimed is:

1. An apparatus for pumping or compressing a fluid, comprising:

a housing;

a crankshaft disposed in the housing for receiving a rotative driving force;

a crank disposed in the housing and connected to the crankshaft for converting a rotating motion of the crankshaft to a reciprocating motion;

a crosshead disposed in the housing and connected to the crank, the crosshead having a reciprocating motion;

a crosshead extension rod connected to the crosshead;

an alignment adapter having first and second ends, the first end being secured to the crosshead extension rod, the second end having a cavity, the cavity having a hemispherical portion;

a piston rod having first and second ends, the first end being received in the cavity of the alignment adapter;

a cylinder disposed in the housing; and a sealing apparatus connected to the second end of the piston rod, the sealing apparatus being sealingly disposed in the cylinder, the sealing apparatus reciprocating in the cylinder and being capable of pumping or compressing the fluid.

2. The apparatus of claim 1, wherein the alignment adapter comprises:

a body having a generally cylindrical shape, a length, and a longitudinal axis, the body having the first and second ends;

the first end having a flange extending radially from the body, the flange being adapted for matingly engaging the crosshead extension rod;

the body having a cylindrical section adjacent to the second end; and the cavity in the second end having a cylindrical portion proximate to the second end, the hemispherical portion being adjacent to the cylindrical portion.

3. The apparatus of claim 1, wherein the first end of the piston rod terminates with a projecting hemispherical shape that is matingly received by the hemispherical portion of the cavity in the alignment adapter.

4. The apparatus of claim 1, wherein the first end of the piston rod has a cavity that is hemispherical in shape, further comprising a ball located between the alignment adapter and the piston rod, the ball being located within the cavity in the alignment adapter and within the cavity in the first end of the piston rod.

5. The apparatus of claim 1, wherein the piston rod has a groove about its circumference proximate to its first end, further comprising a split ring received in the groove, wherein the split ring is received within the cavity in the alignment adapter.

6. The apparatus of claim 5, wherein the alignment adapter has a plurality of threaded holes, further comprising a bolt received in each threaded hole, each bolt pressing the split ring into the groove in the piston rod.

7. The apparatus of claim 5, wherein the split ring has inner and outer layers, the inner layer comprising a resilient material, the outer layer comprising a metal material.

8. The apparatus of claim 1, wherein the sealing apparatus is a piston head.

9. The apparatus of claim 1, wherein the sealing apparatus is a plunger.

10. The apparatus of claim 1, wherein the sealing apparatus includes a piston head and a seal engaged with the piston head, the piston head having a cavity for receiving the second end of the piston rod.

11. The apparatus of claim 10, wherein the cavity in the piston head includes a hemispherical shape, and wherein the second end of the piston rod terminates in a projecting hemispherical shape that is matingly received in the cavity in the piston head.

12. The apparatus of claim 11, wherein the piston head has a length and first and second ends, the first end of the piston head being distal to the piston rod, the second end of the piston head having the cavity that receives the second end of the piston rod, the piston head having a longitudinal midpoint located centrally between the first and second ends of the piston head, the projecting hemispherical shape of the second end of the piston rod having a focal point for a center of radius, and wherein the focal point of the center of radius of the projecting hemispherical shape of the second end of the piston rod is located between the first end of the piston head and the longitudinal midpoint of the piston head.

13. An apparatus for pumping or compressing a fluid, comprising:

a housing;

a crankshaft disposed in the housing for receiving a rotative driving force;

a crank disposed in the housing and connected to the crankshaft for converting a rotating motion of the crankshaft to a reciprocating motion;

a crosshead disposed in the housing and connected to the crank, the crosshead having a reciprocating motion;

a crosshead extension rod connected to the crosshead;

a piston rod having first and second ends, the first end being secured to the crosshead extension rod;

a piston cylinder disposed in the housing;

a piston head having a cavity for receiving the second end of the piston rod, the cavity in the piston head including a hemispherical shape, the second end of the piston rod terminating in a projecting hemispherical shape that is matingly received within hemispherical shape in the cavity in the piston head, the piston head being disposed in the piston cylinder; and a seal engaged with the piston head, the seal providing a sealing surface within the piston cylinder.

14. The apparatus of claim 13, wherein the piston rod has a groove around its circumference proximate to its second end, further comprising a split ring located in the groove, the split ring being located within the cavity in the piston head.

15. The apparatus of claim 14, wherein the piston head has a plurality of tapped holes, further comprising a bolt threadedly engaged with each tapped hole in the piston head, the bolts pressing the split ring into the groove in the piston rod.

16. The apparatus of claim 13, wherein the piston head has a length and first and second ends, the first end of the piston head being distal to the piston rod, the second end of the piston head having the cavity that receives the second end of the piston rod, the piston head having a longitudinal midpoint located centrally between the first and second ends of the piston head, the projecting hemispherical shape of the second end of the piston rod having a focal point for a center of radius of the projecting hemispherical shape, and wherein the focal point of the center of radius of the projecting hemispherical shape of the second end of the piston rod is located between the first end of the piston head and the longitudinal midpoint of the piston head.

17. The apparatus of claim 13, wherein the piston head has a solid body, the body having a length and first and second ends, the first end of the body of the piston head being distal to the piston rod, the second end of the body of the piston head having the cavity that receives the second end of the piston rod, the body of the piston head having a shoulder located centrally between the first and second ends of the body of the piston head, the shoulder extending radially from the body, and wherein the seal is engaged about the body and located between the first end and the shoulder, the shoulder providing support for the seal.

18. The apparatus of claim 13, further comprising an alignment adapter located between the crosshead extension rod and the first end of the piston rod.

19. The apparatus of claim 18, wherein the alignment adapter has first and second ends, the first end being secured to the crosshead extension rod, the second end having a cavity, the cavity in the alignment adapter having a cylindrical portion proximate to the second end and a hemispherical portion adjacent to the cylindrical portion.

20. The apparatus of claim 19, wherein the first end of the piston rod terminates with a projecting hemispherical shape that is matingly received by the hemispherical portion of the cavity in the alignment adapter.

21. The apparatus of claim 13, further comprising a standardization adapter located between the crosshead extension rod and the first end of the piston rod.

22. The apparatus of claim 21, wherein the standardization adapter has first and second ends, the first end being secured to the crosshead extension rod, the second end having a cavity, the cavity in the standardization adapter having a cylindrical shape.

23. The apparatus of claim 22, wherein the piston rod has a groove about its circumference proximate to its first end, further comprising a split ring located in the groove proximate to the first end of the piston rod, wherein the split ring is received within the cavity in the standardization adapter.

24. The apparatus of claim 23, wherein the standardization adapter has a plurality of tapped holes arranged circumferentially about the standardization adapter, further comprising a bolt engaged in each tapped hole, the bolts pressing the split ring into the groove proximate to the first end of the piston rod.

25. An apparatus for pumping or compressing a fluid, comprising:

a housing;

a crankshaft disposed in the housing for receiving a rotative driving force;

a crank disposed in the housing and connected to the crankshaft for converting a rotating motion of the crankshaft to a reciprocating motion;

a crosshead disposed in the housing and connected to the crank, the crosshead having a reciprocating motion;

a crosshead extension rod connected to the crosshead, the crosshead extension rod having a flanged end distal to the crosshead;

a standardization adapter, the standardization adapter having first and second ends, the first end having a flange that is approximately a mirror image of the flanged end of the crosshead extension rod, the second end having a cavity;

a clamp securing the flange of the standardization adapter to the flanged end of the crosshead extension rod;

a piston rod having first and second ends, the first end of the piston rod being coupled to the second end of the standardization adapter, the first end of the piston rod being inserted into the cavity in the second end of the standardization adapter;

a cylinder disposed in the housing; and a sealing apparatus connected to the second end of the piston rod, the sealing apparatus being sealingly disposed in the cylinder, the sealing apparatus reciprocating in the cylinder and being capable of pumping or compressing the fluid;

wherein the sealing apparatus includes a piston head and a seal engaged with the piston head, the piston head having a hemispherically-shaped cavity, the second end of the piston rod having a hemispherically-shaped projection that matingly fits within the hemispherically-shaped cavity in the piston head.

26. The apparatus of claim 25, wherein the first end of the piston rod is threaded into the second end of the standardization adapter.

27. An alignment adapter for use in coupling first and second rods end to end, the alignment adapter allowing misalignment between the longitudinal axis of the first rod and the longitudinal axis of the second rod, the alignment adapter comprising:

a body having a generally cylindrical shape, a length, a longitudinal axis, and first and second ends;

the first end having a flange extending radially from the body;

the body having a cavity in the second end, the cavity extending inwardly into the body along the longitudinal axis of the body;

the cavity having cylindrically-shaped portion adjacent to the second end; and the cavity having a hemispherically-shaped portion located inwardly of the cylindrically-shaped portion.

28. The alignment adapter of claim 27, wherein the body has a plurality of tapped holes passing radially through the body into the cylindrically-shaped portion of the cavity.

29. A piston head for use in a reciprocating pump or compressor, comprising:

a body having a generally cylindrical shape, a length, a longitudinal axis, an outside surface, and first and second ends;

a flange extending radially from the body between the first and second ends, the flange being capable of supporting a resilient seal;

an indentation formed around the circumference of the body in the outside surface proximate to the first end, the indentation being capable of engaging the resilient seal;

the body having a cylindrical section between the flange and the second end;

the body having a cavity extending inwardly from the second end along the longitudinal axis;

the cavity having cylindrically-shaped portion adjacent to the second end; and the cavity having a hemispherically-shaped portion located inwardly of the cylindrically-shaped portion.

30. The piston head of claim 29, wherein the body has a plurality of tapped holes passing radially through the cylindrical section into the cylindrically-shaped portion of the cavity.

31. A standardization adapter for use in coupling an end of a crosshead extension rod to an end of a piston rod, the crosshead extension rod and the piston rod being located in a reciprocating pump or compressor, the end of the crosshead extension rod having a flanged end, the flanged end having a cylindrical recess, the standardization adapter comprising:

a body having a generally cylindrical shape, a length, a longitudinal axis, and first and second ends;

the first end having a flange extending radially from the body;

the flange having a shape suitable for clamping to the flanged end of the crosshead extension rod;

the flange having a cylindrical projection extending outwardly along the longitudinal axis, the cylindrical projection having a shape suitable for matingly engaging the cylindrical recess in the flanged end of the crosshead extension rod;

the body having a cylindrical section between the flange and the second end; and the body having a generally cylindrically-shaped cavity extending inwardly from the second end along the longitudinal axis for receiving the end of the piston rod.

32. A piston rod, comprising:

a body having a length and first and second ends;

the first end terminating in a projection having a hemispherical surface;

the first end having a cylindrical surface adjacent to the hemispherical surface; and the first end having a groove about its circumference, the groove providing an indentation in the cylindrical surface.

33. A service kit for a self-aligning joint, the self-aligning joint including a first machined part having a generally cylindrical shape, a cavity and a plurality of threaded holes, the cavity having a cylindrical portion and a hemispherical portion adjacent to the cylindrical portion; and a second machined part comprising a piston rod having an end with a hemispherical projection and a circumferential groove proximate to the hemispherical projection, the service kit comprising:

a split ring adapted for fitting in the circumferential groove, the split ring having an outer metal layer and an inner resilient layer; and a plurality of bolts, each bolt adapted for engagement in one of the plurality of threaded holes.

* * * * *